US008590124B2

(12) United States Patent
Bäumer

(10) Patent No.: US 8,590,124 B2
(45) Date of Patent: Nov. 26, 2013

(54) SUPPORT FOR A METAL COIL AND APPARATUSES COMPRISING SUCH A SUPPORT

(75) Inventor: Klaus Bäumer, Kreuztal (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 13/518,983

(22) PCT Filed: Dec. 22, 2010

(86) PCT No.: PCT/EP2010/070447
§ 371 (c)(1),
(2), (4) Date: Aug. 14, 2012

(87) PCT Pub. No.: WO2011/076821
PCT Pub. Date: Jun. 30, 2011

(65) Prior Publication Data

US 2012/0317774 A1 Dec. 20, 2012

(30) Foreign Application Priority Data

Dec. 23, 2009 (DE) ..... 10 2009 060 257

(51) Int. Cl.
*B21C 47/24* (2006.01)
*B21B 39/00* (2006.01)

(52) U.S. Cl.
USPC ..... 29/33 S; 242/595; 242/595.1; 242/547

(58) Field of Classification Search
USPC ..... 242/564.4, 595.1, 541.4, 541.5, 542, 242/547, 541.1, 541.6, 541.7, 595, 594.1; 29/33 F, 33 Q, 33 S, 819, 820
See application file for complete search history.

(56) References Cited

U.S. PATENT DOCUMENTS

| | | | | |
|---|---|---|---|---|
| 1,765,451 | A * | 6/1930 | Schane | 242/595.1 |
| 1,885,612 | A * | 11/1932 | Littell | 242/564.4 |
| 2,122,674 | A | 7/1938 | Wardle | |
| 2,267,161 | A * | 12/1941 | Miller | 242/420.1 |

(Continued)

FOREIGN PATENT DOCUMENTS

| | | |
|---|---|---|
| EP | 0044923 A2 | 2/1982 |
| EP | 1683588 A1 | 7/2006 |

(Continued)

*Primary Examiner* — David Bryant
*Assistant Examiner* — Jason L Vaughn
(74) *Attorney, Agent, or Firm* — Lucas & Mercanti, LLP; Klaus P. Stoffel

(57) ABSTRACT

The invention relates to a support for metal coils (1, 11, 31), wherein a metal coil (1, 11, 31) substantially has a circular circumference as viewed in cross section and the support comprises at least three support points (2, 2', 12, 32), which are arranged in such a manner as to make contact with the metal coil (1, 11, 31) in the circumferential direction of the metal coil (1, 11, 31) when the metal coil (1, 11, 31) is laid on the support. The support permits particularly secure storage and/or transportation.

13 Claims, 8 Drawing Sheets

(56) References Cited

U.S. PATENT DOCUMENTS

| | | | | |
|---|---|---|---|---|
| 2,285,358 | A | 6/1942 | Rode et al. | |
| 2,581,711 | A * | 1/1952 | Roselius | 242/563.2 |
| 3,098,619 | A * | 7/1963 | Washburn | 242/541.3 |
| 3,851,832 | A * | 12/1974 | Krueckels et al. | 242/541.6 |
| 3,889,831 | A | 6/1975 | Davis | |
| 4,096,724 | A | 6/1978 | Eshelman et al. | |
| 4,344,605 | A | 8/1982 | Ganseuer et al. | |
| 5,310,131 | A * | 5/1994 | Monaco et al. | 242/550 |
| 6,161,792 | A * | 12/2000 | Kayser | 242/541.5 |
| 7,507,045 | B1 * | 3/2009 | Harris et al. | 400/613 |
| 7,549,529 | B2 | 6/2009 | Dreisbach et al. | |
| 7,874,510 | B2 * | 1/2011 | Martin et al. | 242/595.1 |
| 8,096,158 | B2 | 1/2012 | Moser et al. | |

FOREIGN PATENT DOCUMENTS

| | | | |
|---|---|---|---|
| EP | 1683588 | B1 | 2/2008 |
| EP | 1888284 | B1 | 5/2009 |
| GB | 607350 | A | 8/1948 |
| WO | 9109694 | | 7/1991 |
| WO | 2006111259 | A1 | 10/2006 |

* cited by examiner

SUPPORT FOR A METAL COIL AND APPARATUSES COMPRISING SUCH A SUPPORT

The present application is a 371 of International application PCT/EP2010/070447, filed Dec. 22, 2010, which claims priority of DE 10 2009 060 257.7, filed Dec. 23, 2009, the priority of these applications is hereby claimed and these applications are incorporated herein by reference.

BACKGROUND OF THE INVENTION

The invention relates to the field of storing and processing metal coils.

Today's hot wide strip rolling trains are configured for producing high strength material, for example, with thicknesses of up to 30 mm. The strip to be coiled in this case must be shaped elastically and plastically in a reeling plant. In other words, the metal coil must be managed with respect to its shape. After shaping the coil it must be ensured that the coil shape is retained.

Unfortunately, in accordance with the present state of the art, it may happen that the metal coil opens like a clock spring because of its internal tension and the windings of the coil have intermediate spaces relative to each other. If such coil is loosened as described, this results in a high danger of accidents to the operators on the one hand, and on the other hand, in the risk of significant damage to the plant. In addition, the surface quality of the coiled metal strip may be impaired.

Therefore, in accordance with the present state of the art, in a reeling plant or immediately following, a metal coil is tied several times by means of a binding band, or the last coil winding is welded to the penultimate winding in order to prevent opening of the coil. Simultaneously, the coil is positioned in such a way that the strip end is clamped into a trough, so that the coil cannot open up or roll away. However, for this purpose, a certain minimum weight of the coil is disadvantageously necessary to exceed the internal tension of the coil. Moreover, the binding bands used are frequently not sufficient in every case, even with multiple bindings, to compensate for the internal tension of the metal coils. Especially when moving metal strips, for example, between various troughs, relative movements between the metal coils and the binding bands occur so that the coil is damaged or—even worse—the metal coil opens and the serious consequences already discussed above could result.

European Patent 1 683 588 B1 shows a device for transporting metal coils on pallets. This document primarily deals with making available a device which constitutes an operationally safe transport system in spite of cumulative influences of load and heat and ensures a stable travel direction of a pallet. The support disclosed in this document includes essentially four rigid support members which assume fixed positions relative to each other. A metal coil resting in this support has only two support points in the circumferential direction of the coil, or in a cross section extending perpendicularly of the axis of rotation of the metal coil. This arrangement has the disadvantage that also in this device a sufficient safety for moving the metal coils is not ensured. It shall be briefly clarified at this point that in such devices frequently additional rollers are used which, for example, can be placed against the coil from above, such as for uncoiling an opened coil. However, such rollers do not serve as support for the coil.

The publication GB 607,350 discloses a coil support with a plurality of support parts which each rotatably supports a pair of shaft bearing rollers.

The publication U.S. Pat. No. 2,285,358 discloses a coil support with a plurality of rollers for storing a metal coil. Always two of these rollers are held by a pivotable clamp, so that the metal coil can be placed on two pivotable clamps arranged next to each other, including their rollers.

The publication U.S. Pat. No. 4,096,724 discloses a method and a device for coiling a metal coil. In particular, two pivotable lever arm arrangements are used in order to ensure coiling of the coil with a changing diameter of the coil.

The publication WO 91/09694 A1 discloses a device for manipulating metal strip. In particular, after traveling through an induction heating unit, the metal strip is placed in coils onto pivoting frames which each support two rollers.

The publication U.S. Pat. No. 2,122,674 discloses a device for uncoiling a metal coil. The metal coil is placed on roller pairs which are supported in a yoke. The yoke can be pivoted through a shaft and a corresponding worm drive.

The technical object which results from the state of the art is to make available an improved device for storing and or for transporting metal coils, or to overcome at least one of the above mentioned disadvantages.

SUMMARY OF THE INVENTION

The technical object is met by the device according to the invention which comprises a support for a metal coil which has essentially the circular cross section with a circular circumference, wherein the support has at least three support points which are arranged in such a way that they contact the metal coil in the direction of the circumference at least at three points when the metal coil is placed on the support. The object according to the invention overcomes the disadvantages of the prior art. By making available three support points in the circumferential direction, it can serve the purpose of providing a secure support and secure transport of metal coils.

In a preferred embodiment of the support, the support comprises at least one support member on which is arranged a support lever, preferably a rotatable support lever, and wherein two rollers, preferably rotatable rollers, are arranged at the support lever, wherein the rollers form two of the support points on which the metal coil is placed. As a result of this arrangement, a metal coil is placed particularly safely in the support. As a result of the rotatable support levers, this device can be used for different metal coil cross sections.

In accordance with another preferred embodiment of the support, the at least one support member and the two rollers of the support member essentially form a triangle extending in a cross section, extending perpendicularly of the axis of rotation of the metal coil.

In accordance with another preferred embodiment of the support, the support points and/or the at least one support member of the support are arranged and constructed in such a way that they contact the metal coil along a partial circle circumference of up to 150 degrees. As a result of this arrangement of the support points, or rollers, the metal coil can be secured particularly well on or in the support.

In accordance with another preferred embodiment of the support, the support comprises four support points. By providing four or at least four support points in the circumferential direction, a metal coil can rest even more securely in the support.

In accordance with another preferred embodiment of the support, the support comprises two support members on each of which is arranged a support lever, preferably a rotatable support lever, and wherein two rollers are arranged at each support lever, wherein the rollers form the support points and the metal coil can be placed on the support points. As a result of this arrangement, a metal coil rests particularly securely in the support. Because of the rotatable support levers, this device can be used especially for different metal coil cross sections.

In accordance with another preferred embodiment of the support, the horizontal spacing of the bearing points is constructed so as to be adjustable. Since optionally the spacing of the bearing points, particularly the horizontal distance between the bearing points, is adjustable the support can be used for many different coil diameters or coil cross sections. As a result, the support can be variably used.

In accordance with another preferred embodiment of the support, the support comprises a support member as well as another roller which is arranged in such a way that it forms a third support point which contacts the metal coil in the direction of the circumference, when the metal coil is placed on the support. As a result of this embodiment of the support, the advantage of the above described support can be utilized, on the one hand, however, on the other hand, a third support point is formed by a simple roller which simplifies the construction of the system.

In accordance with another preferred embodiment of the support, the horizontal spacing of the support member and of the additional roller is arranged so as to be adjustable. As a result of the fact that the spacing between the additional roller and the support member, particularly the two rollers thereof, is constructed so as to be adjustable, coils having various coil diameters can be placed.

In accordance with a preferred embodiment of the support, each support point is formed by a roller, which extends essentially parallel to the axis of rotation of the metal coil. Since the support points are formed by rollers which extend parallel to the axis of rotation of the metal coil, the manipulation of the metal coils on the support is simplified; in particular, the rollers may be constructed so as to be rotatable, but they may also be constructed to be rigid.

In accordance with a further preferred embodiment of the support, the rollers extend over the entire width of the metal coil. This ensures a good load bearing capacity and transportability of the support.

In accordance with another preferred embodiment of the support, the rollers are driven. If the rollers of the support are driven, they can be used, for example, directly for uncoiling and coiling the metal strip in a sample pick-up station.

Furthermore, the invention comprises a sample pick-up station for picking up samples of a metal coil which comprises the following: a support according to the invention, as well as means, preferably a chisel, for opening the metal coil; means, preferably shears, for severing a sample piece and/or an end crop, and means for binding the metal coil after removal of a sample. In particular, but not exclusively, in a sample removal station, the support, according to the invention has the advantages which were already discussed above.

In a preferred embodiment, the sample removal station comprises at least one contact pressure roller which is arranged and constructed in such a way that it can be pressed essentially from above against the metal coil in order to prevent an opening of the unlocked metal coil and/or means for winding back the metal coil.

Moreover, the invention comprises a pallet system, particularly for storing and transporting metal coils, which comprises a pallet which, in turn, comprises the support according to the invention. If the support according to the invention is intended for contact with a pallet, the device can be used even more flexibly.

In accordance with a preferred embodiment of the pallet system, means for connecting a crane transport are provided on the pallet and/or the support. By providing the means for crane transport, such as standard connections, or hooks and eyes, the pallet system can be transported between various plants or can be placed in a simple manner onto a vehicle.

The invention further comprises a reeling device, particularly a hot strip reeling device, which comprises a reel mandrel and the above described support according to the invention and/or the above described pallet system, wherein the reeling device is constructed in such a way that a metal coil which is resting on the reel mandrel can be placed on the support or on the pallet system. By means of the support according to the invention or the pallet system according to the invention, the reel can be operated particularly efficiently with respect to time and safely.

Moreover, the invention comprises a method for removing a sample piece or end crop from the above described sample removal station, which comprises the following steps: placing the metal coil on the support; placing the at least one contact pressure roller onto the upper side of the metal coil; cutting the metal coil; uncoiling the metal coil; cutting off a sample or the end crop; coiling back the metal coil, and finally, optionally binding the metal coil.

Finally, the invention comprises a method for coiling a metal coil with the above described reeling device which comprises the following steps: coiling the metal coil on the reel mandrel as well as pulling off the metal coil including the support according to the invention or the pallet system according to the invention from the reel mandrel.

BRIEF DESCRIPTION OF THE DRAWING

In the following, the Figures of the embodiments are briefly described. Further details can be found in the detailed description of the embodiments. In the drawing.

DETAILED DESCRIPTION OF THE INVENTION

Figure 1:
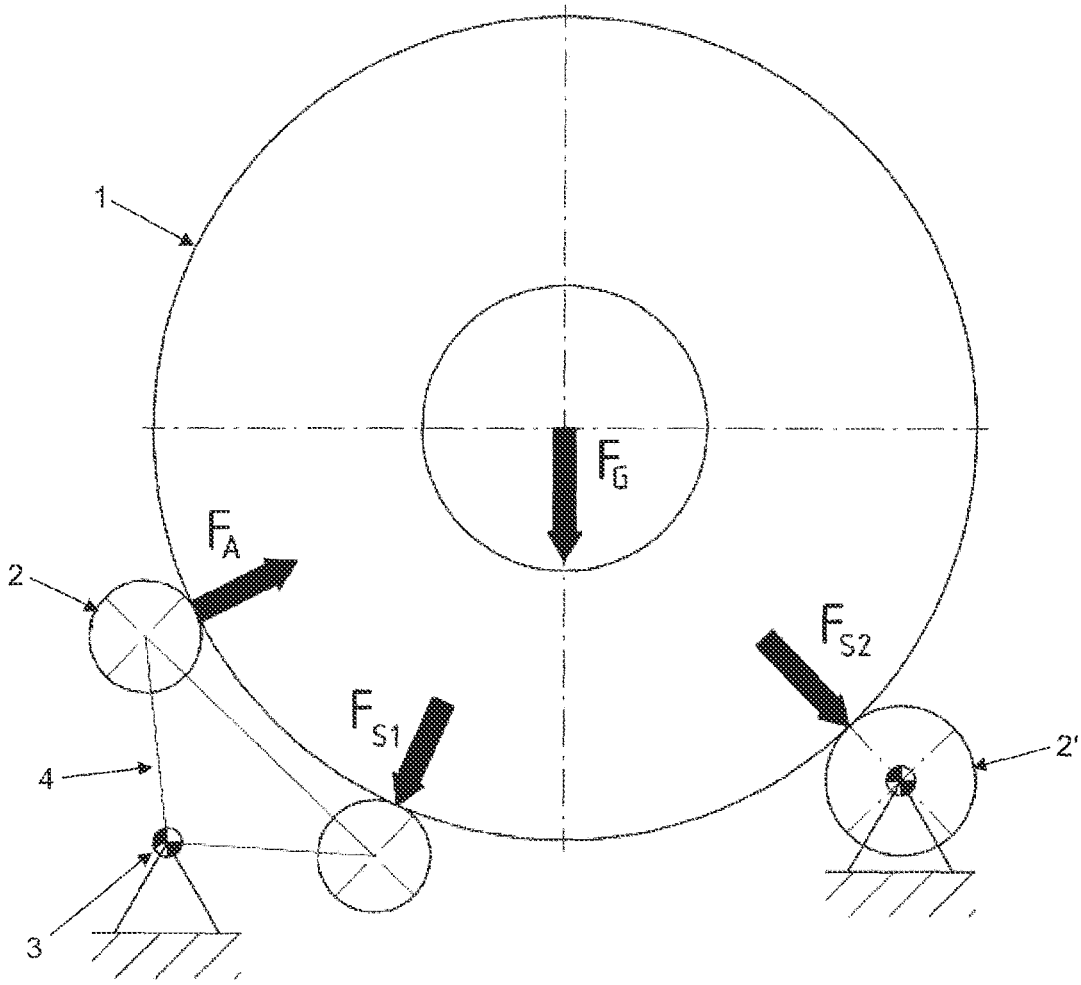
FIG. 1 shows a schematic cross sectional view of a first embodiment of metal coil support pursuant to the invention.

FIG. 1 shows a first schematic embodiment of a support according to the invention. Illustrated is a metal coil 1 which rests on three support points 2, 2'. These three support points 2, 2' are arranged, as seen in the cross section, in the direction of the circumference of the coil 1 when a metal coil 1 is placed on the support points 2, 2'. In this case, the cross section of FIG. 1 extends perpendicularly of the axis of rotation or the coiling axis of the metal coil 1. In particular, the support points 2, 2' can be constructed as rollers 2, 2' or bearing rollers 2, 2' or, in other words, by support rollers 2, 2'. Preferably, two rollers 2 are arranged at a support lever 4 which, in turn, is arranged preferably rotatably, on a support 3. Additionally, in this embodiment a roller 2' is provided which contacts the circumference of the metal coil 1 and forms a third support point 2', in addition to the two rollers 2. The rollers 2, 2' are preferably constructed so as to be rotatable and/or driven, however they can also be of rigid construction. Preferably, two rollers 2 form a pair of rollers which are arranged on a support lever 4. In particular, a triangle is essentially formed by two rollers 2 together with a fulcrum of a support lever 4 or the support 3. The illustrated device comprises a support 3 on which a support lever 4 is arranged. However, it is also possible to provide several such supports 3 with support levers 4 and rollers 2. A metal coil 1, which is placed on a support constructed in accordance with FIG. 1 exerts with its weight force $F_G$, inter alia, a force $F_{S1}$ against the lower roller 1 of the support 3 and a force $F_{S2}$ against the additional roller 2'. As a result the support 3 exerts, through the lever 4 which is rotatable about the support 3, a torque against the upper roller 2 of the support 3. Accordingly, the upper roller 2 is pressed with a force $F_A$ against the metal coil 1. By means of a support constructed in this manner, metal coils 1, especially with different diameters or cross sections, can be supported even more securely.

Figure 2:
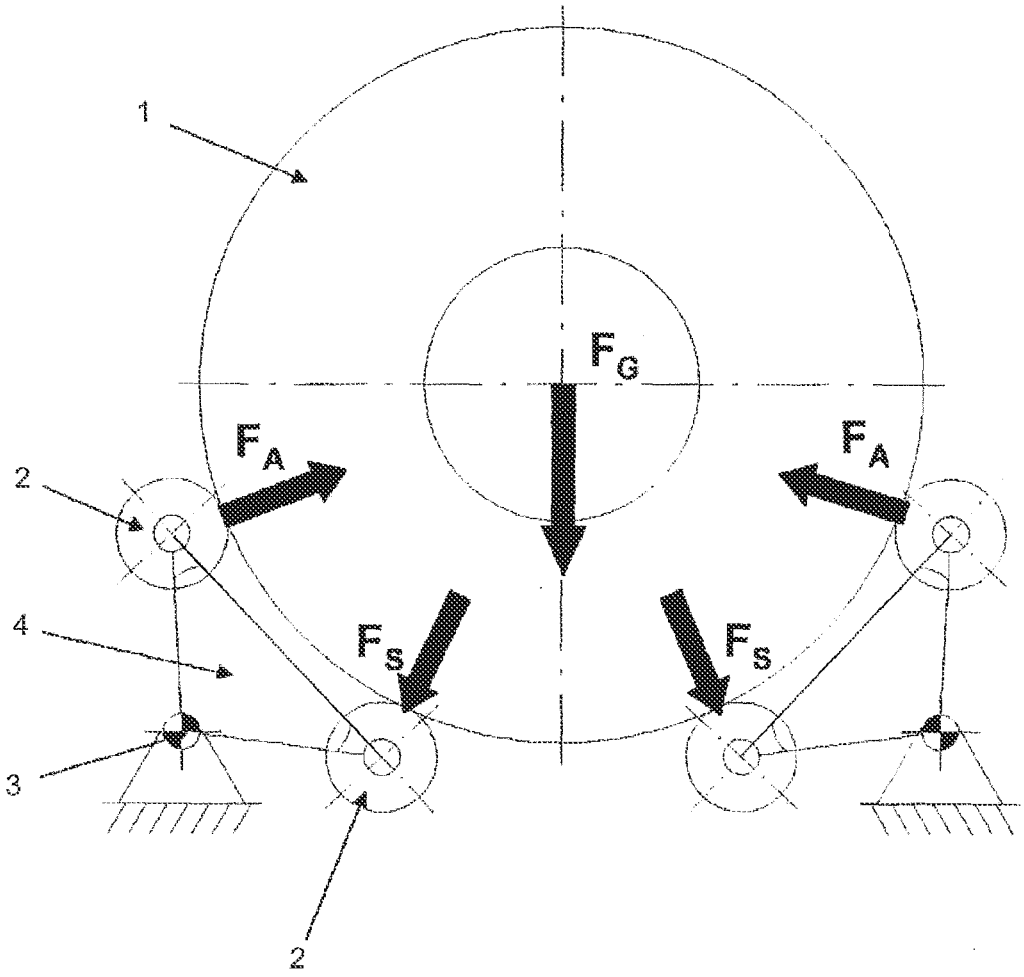
FIG. 2 shows a schematic cross sectional view of a second embodiment pursuant to the invention of a metal coil support.

FIG. 2 shows a schematic embodiment of another support according to the invention. As in FIG. 1, illustrated is a metal coil 1 which, however, rests on four support points 2. These four support points 2 are arranged, as seen in cross section, in the direction of the circumference of the metal coil 1 when a metal coil 1 rests on the four support points 2. The cross section of FIG. 2 extends also perpendicularly of the axis of rotation or coiling axis of the metal coil 1. Once again, the support points 2 can be formed by rollers 2 or by bearing rollers 2, or, expressed differently, by support rollers 2. Preferably, two rollers 2 are arranged at a support lever 4 which in turn is mounted, preferably rotatably, on a support member 3. The rollers 2 are preferably constructed so as to be rotatable and/or driven, however, they can also be of rigid construction. Preferably, two rollers 2 form a roller pair which is arranged at a support lever 4. In particular, two rollers 2 form essentially a triangle with a fulcrum of a support lever 4 or the support member 3. In total the illustrated support includes preferably two supports 3 on each of which a support lever 4 is arranged. The two supports 3 are arranged, as seen in the cross section of the coil 1, preferably to the right and to the left underneath the coil 1. A metal coil 1 which is placed on a support constructed in this manner exerts with its weight force $F_G$, inter alia, a force against the respectively lower rollers 2 of the respective support 3. As a result, the supports exert through the lever 4 rotatable about the support 3 a torque against the respectively upper rollers 2 of the respective support 3. Consequently, the upper rollers 2 are pressed with a force $F_A$ against the metal coil 1. By means of such a support constructed in this manner, metal coils 1 having various diameters or cross sections can be stored even more safely.

Figure 3:
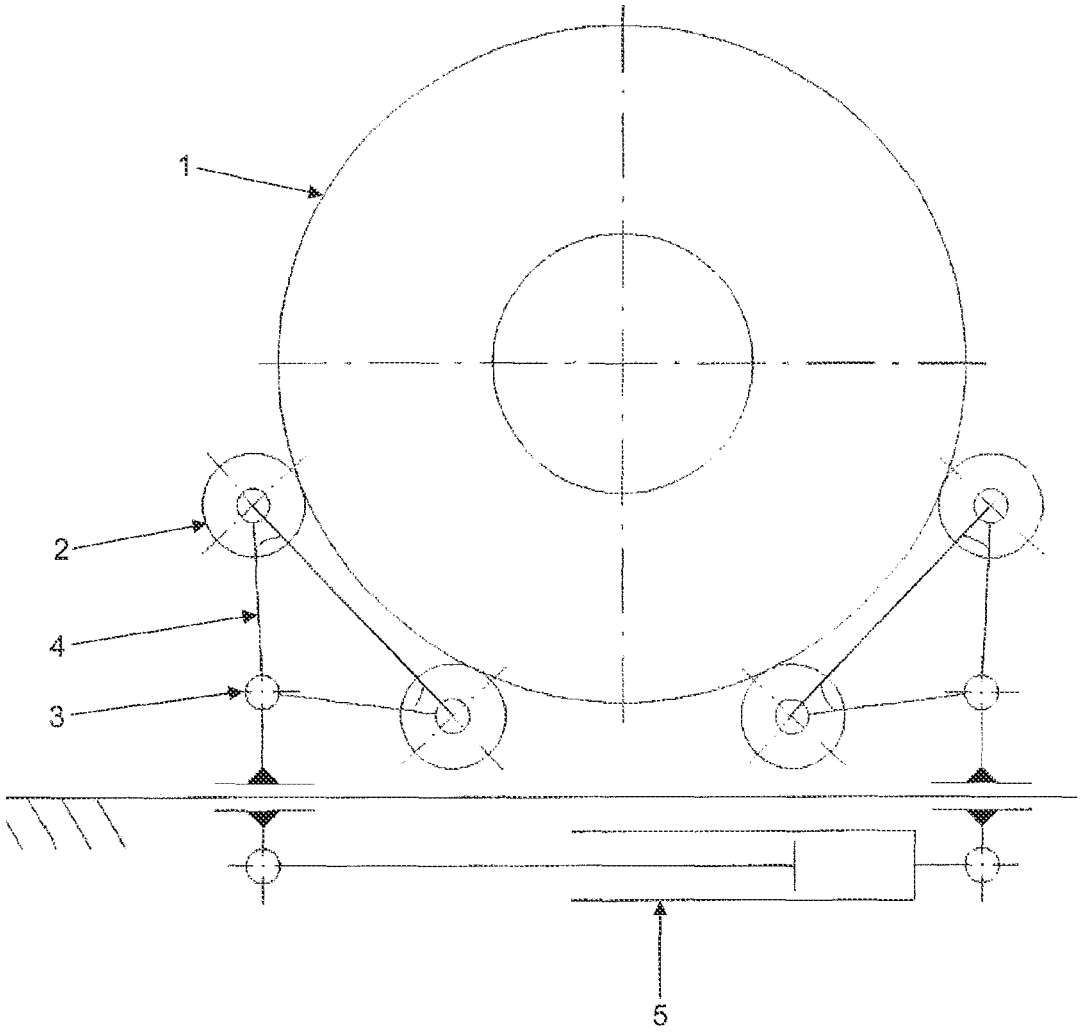
FIG. 3 shows a schematic cross sectional view of a support, similar to FIG. 2, but with a horizontal adjusting device between the individual support members.

FIG. 3 shows a similar embodiment according to the invention as in FIG. 2. However, compared to the device of FIG. 2, the support of FIG. 3 includes an adjusting device 5. This adjusting device has the purpose of adjusting the spacing of the supports 3 and, thus, of storing or transporting an almost complete spectrum of various metal coil cross sections. In particular, the adjusting device 5 is arranged to be adjustable horizontally, optionally underneath the support 3. The adjusting device can be formed, for example, by a piston/cylinder unit 5. The support according to FIG. 1 can also be equipped with such a horizontal adjusting device 5.

Figure 4:
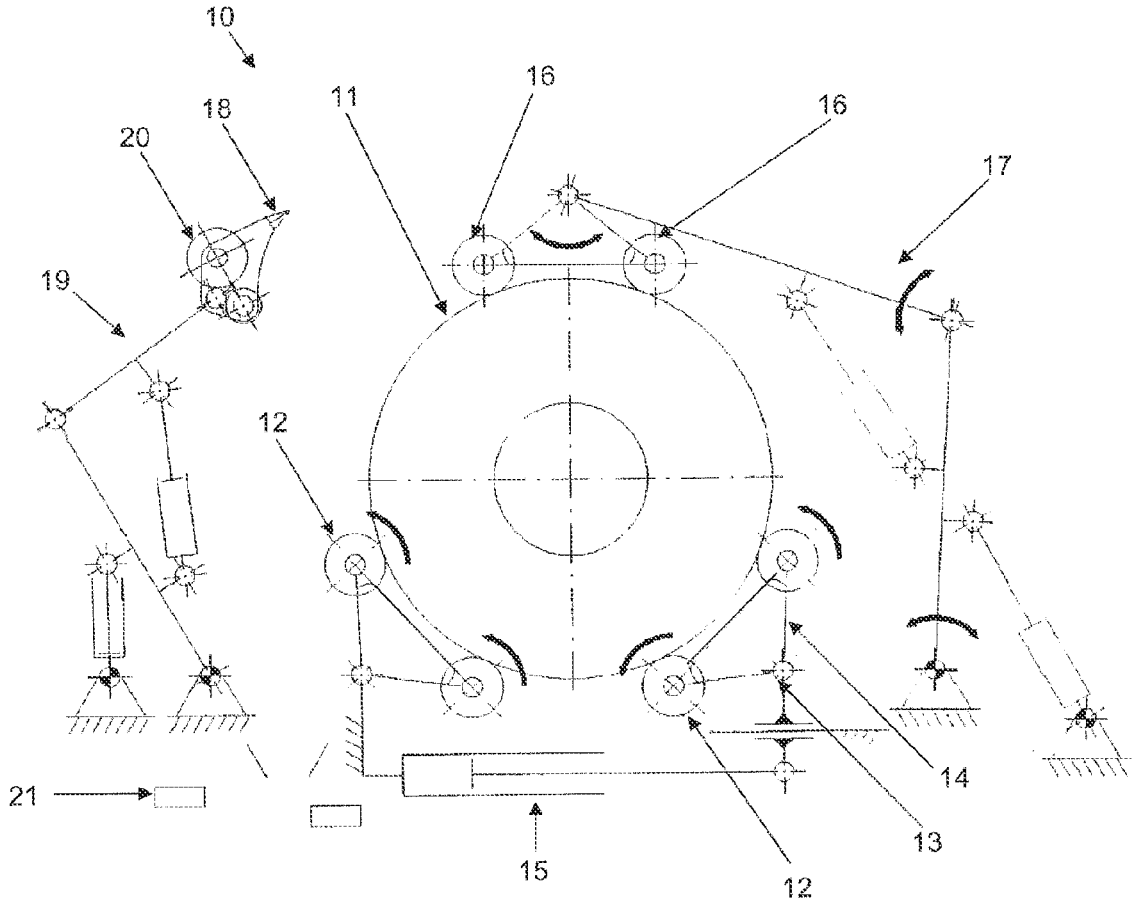
FIG. 4 shows an embodiment of a sample removal station which comprises a support and a metal coil, for example, according to FIG. 3.
Figure 5:
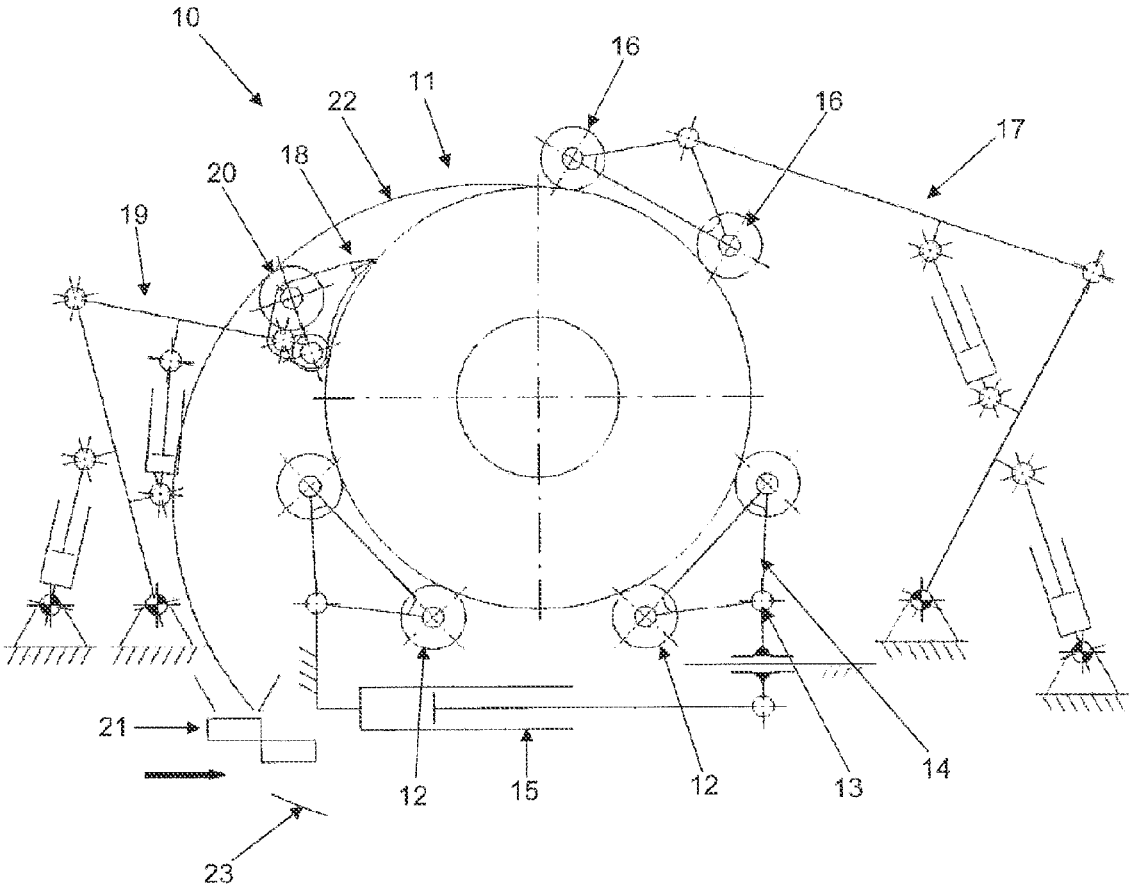
FIG. 5 shows the sample removal station according to FIG. 4, but with already cut metal coil and a cut off sample.
Figure 6:
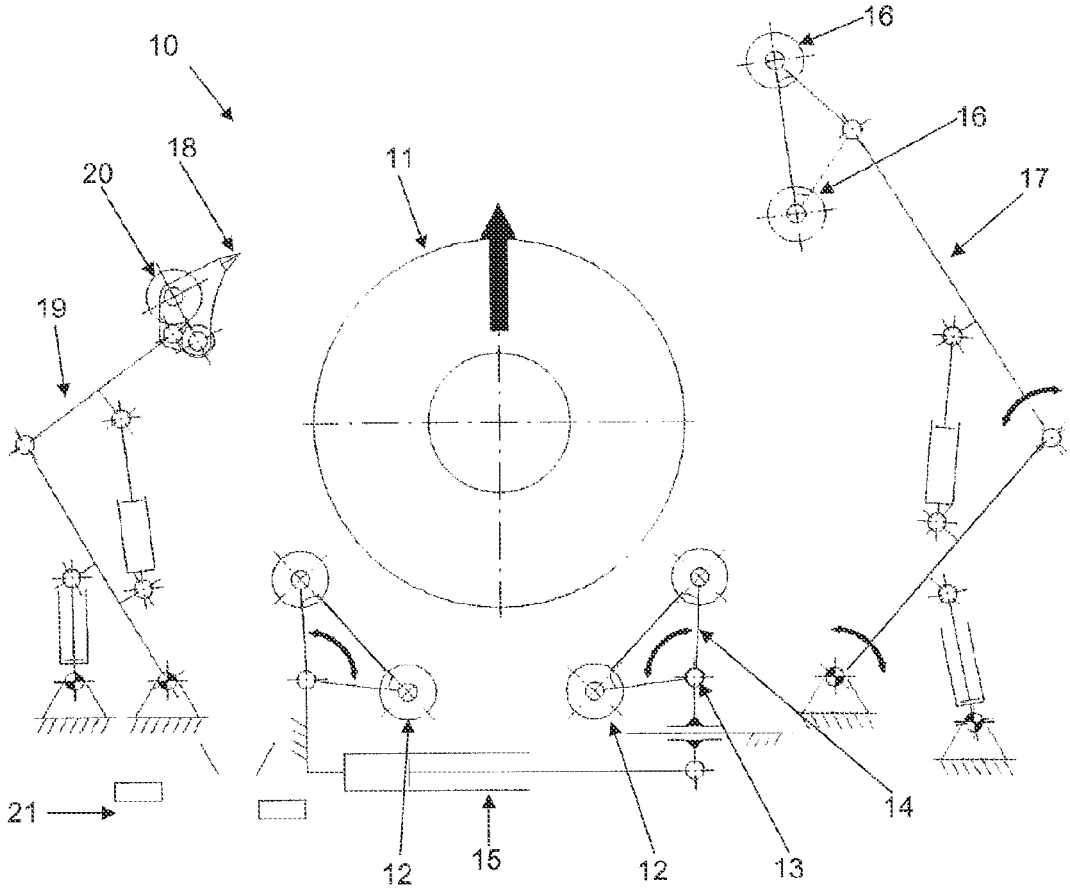
FIG. 6 shows the sample removal station according to FIG. 4 or 5 during the removal of the metal coil from the station.

FIGS. 4, 5, 6 show an embodiment of a sample removal station 10 for removing samples 23 of a metal coil 1, 11. In FIG. 4, a metal coil 11 is illustrated, analogous to the illustration in FIG. 3, on a support according to the invention with rollers 12, adjusting device 15, supports 13 and support levers 14. For opening the metal coil 11 a cutting device 19 with means 18 for severing the metal coil 11 is provided. In this embodiment of FIG. 4, the rollers 12 are driven, so that the metal coil 11 is rotatable optionally in a clock-wise or counter clock-wise direction. Moreover, the sample removal station 10 preferably has shears 21, or dividing shears 21, for cutting off samples 23 from an end 22 of the metal coil 11. In order to ensure that after cutting the coil 11, the cut end 22 of the metal coil 11 does not flap upwardly or outwardly, a contact pressure device 17 is also provided which includes, for example, two contact pressure rollers 16 which are pressed against the upper side of the metal coil 11 placed in the support or are placed against the metal coil 11.

The sample removal station 10 can then be operated, for example, as follows: The metal coil is moved either together with its support into the sample removal station 10 or the support is fixedly installed in the sample removal station 10 and the metal coil 11 is moved into the station 10. Preferably, the rollers 16 of the contact pressure device 17 are then placed against the metal coil 11 from above and the metal coil 11 is turned into a desired position by means of the movable rollers 12. The metal coil 11 is opened by means of the severing means 18, for example, a chisel. As can be seen in FIG. 5, following the cutting of the metal coil 11, the metal coil can be uncoiled by the driven rollers 12 of the support, but also by other drive means or rollers which are not illustrated. For this purpose, for example, the separating means 20, in this case a roller, may be helpful at the severing device 19 to facilitate feeding the metal coil end 22, or the strip end 22, into the shears 21. Subsequently, the shears 21 can sever a sample piece or end crop 23. It shall be mentioned at this point that the construction of the devices 17 and 19 is known by the expert. In a subsequent step, the metal coil can be coiled up again by means of driven rollers, for example, by the rollers 12, and bound by means of a binding device, not shown, which is known from the prior art.

FIG. 6 shows a possibility for removing the metal coil 11 from a sample removal station 10, as it is already illustrated in FIGS. 4 and 5. For removing the coil 11, the devices 17 and 19 are moved or pushed to the side, so that the coil 11 can be lifted upwardly out of the sample removal station 10. Alternatively, the invention also includes the possibility of removing the metal coil 11 together with its support out of the sample removal station 10, for example, including a pallet, downwardly or upwardly or also optionally, to one of the sides of the sample removal station.

Figure 7:
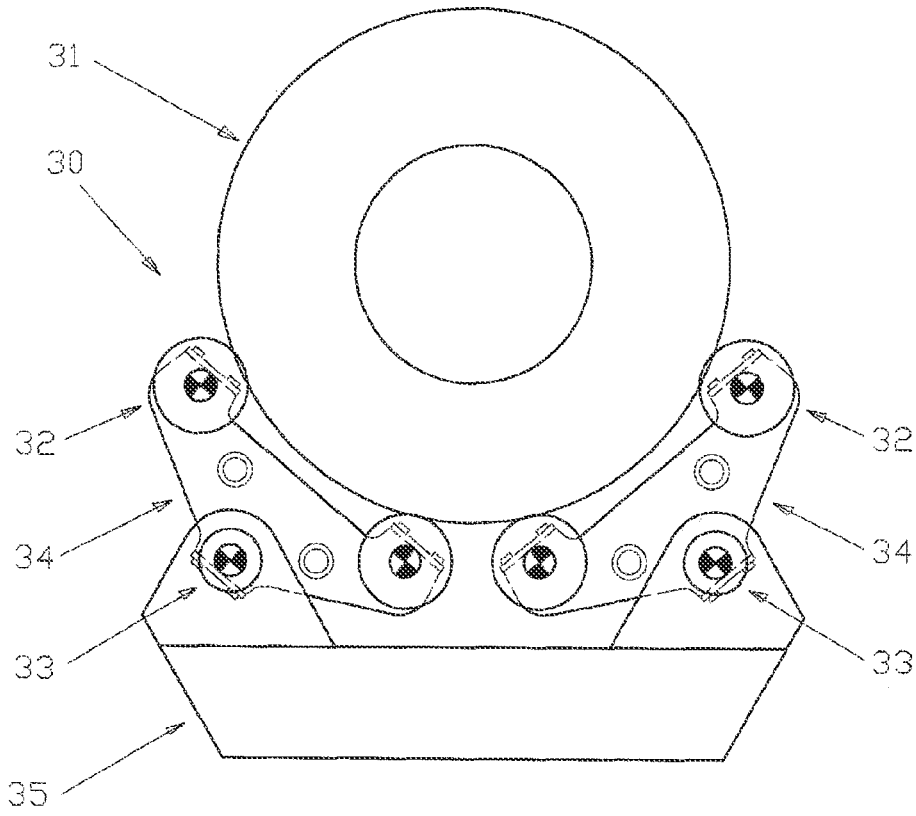
FIG. 7 shows a schematic cross sectional view of an embodiment of a pallet system which comprises a support according to the invention.

FIG. 7 schematically shows a possible embodiment of a pallet system 30 which includes a support according to the invention, for example, according to FIGS. 2 to 6. A metal coil 31, resting on four support points 32, is placed on the illustrated pallet system 30. These points are preferably formed by rollers 32 which are optionally rotatable and/or driven. However, alternatively the support points can also be formed by rigidly arranged support elements. The construction of the support members 33 and support levers 34 preferably corresponds to that of FIGS. 2 to 5. However, these are arranged on a pallet 35 or a carrier 35. The system 30 of FIG. 7 is variably usable, for example, for transportation or for storage. It is also possible to provide means for a crane transport (not shown) on the system 30, particularly on the pallet 35, or also on parts of the support, so that the pallet system 30 can be transported within a manufacturing plant by a crane or can also be loaded for shipment by truck, boat or railroad.

Figure 8:
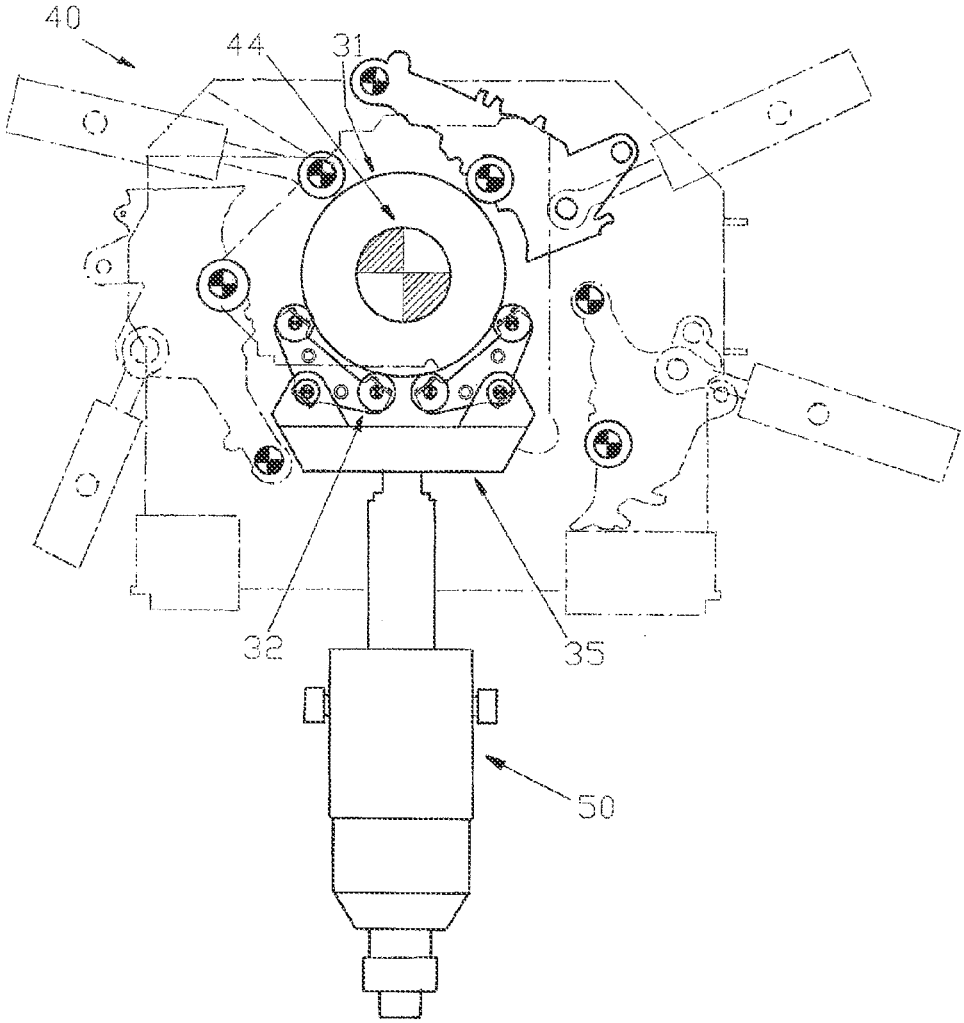
FIG. 8 shows a schematic cross sectional view of a reeling device which is constructed in such a way that a pallet system according to the invention can be used for storing and removing the metal coil from the reel mandrel.

FIG. 8 shows an embodiment of a support according to the invention in a reeling device 40. The illustrated reeling device 40 comprises particularly a reel mandrel 44 on which a metal coil 1, 11, 31 can be coiled. The means for coiling the metal coil 1, 11, 31 are not the focus of the invention and are constructed as known from the prior art. In FIG. 8, the coiled metal coil 31 is placed on the pallet system 30 according to FIG. 7. Also possible is a support without the pallet 35, as shown, for example, for the sample removal station 10. According to FIG. 8, the metal coil 31 can be pulled off in the direction of the axis of the reel mandrel 44. At that time, the coil 31 rests especially on the pallet system 30. Preferably, a coil carriage 50, already known in the art, is used.

Generally, the support illustrated in FIG. 1 can be used in the devices of FIGS. 4 to 8, i.e., in a sample removal station, in a pallet system or in a reeling device.

Finally, it is pointed out that the features of the individual embodiments can be combined or exchanged with each other. In addition, the expert can modify individual structural details in accordance with his normal expert knowledge and adapt them to specific requirements.

LIST OF REFERENCE NUMERALS

1 Metal coil
2 Roller
2' Roller
3 Support
4 Support lever
5 Adjusting device
10 Sample removal station
11 Metal coil
12 Roller
13 Support
14 Support lever
15 Adjusting device
16 Contact pressure roller
17 Contact pressure device
18 Separating means
19 Separating device
20 Separating means
21 Shears
22 Uncoiled coil end
23 Sample/end crop
30 Pallet system
31 Metal coil
32 Roller
33 Support
34 Support lever
35 Pallet
40 Reeling device
44 Reeling mandrel
50 Coil carriage
$F_A$ Adjusting force of an upper roller
$F_G$ Weight force
$F_S$ Force acting on a lower roller
$F_{S1}$ Force acting on a lower roller
$F_{S2}$ Force acting on a roller

The invention claimed is:

1. A support for a metal coil (1, 11, 31), wherein the metal coil (1, 11, 13) has essentially a circular cross section with a circular circumference, and the support comprises at least three support points (2, 2', 12, 32) which are arranged in such a way that they contact the metal coil (1, 11, 31) in the direction of the circumference at least at three points (2, 2', 12, 32) when the metal coil (1, 11, 31) is placed on these support points (2, 2', 12, 32), wherein the support comprises two support members (3, 13, 33) on each of which is arranged one support lever (4, 14, 34), and on each support lever (4, 14, 34) are arranged two rollers (2, 12, 32) that form the support points (2, 12, 32) on which the metal coil (1, 11, 31) can be placed, wherein the horizontal spacing between the support members (3, 13, 33) is constructed so as to be adjustable, wherein adjustment of the horizontal spacing between the support members (3, 13, 33) is provided by a piston cylinder adjustment device (5) coupled to the support members (3, 13, 33).

2. The support according to claim 1, wherein at least one of the support members (3, 13, 33) and the two rollers (2, 2', 12, 32) of the support member (3, 13, 33) form essentially a triangle in a cross section extending perpendicularly to the axis of rotation of the metal coil (1, 11, 31).

3. The support according to claim 2, wherein the support points (2, 2' 12, 32) and the at least one support member (3, 13, 33) of the support are arranged and constructed in such a way that they contact the metal coil (1, 11, 31) along a partial circular circumference of up to 150°.

4. The support according to claim 1, wherein each support point (2, 12, 32) is formed by a roller (2, 12, 32) which extends essentially parallel to the axis of rotation of the metal coil (1, 11, 31).

5. The support according to claim 1, wherein the rollers (2, 2', 12, 32) are constructed so as to be drivable.

6. The support according to claim 1, wherein the rollers (2, 2', 12, 32) extend over the entire width of the metal coil (1, 11, 31).

7. A sample removal, station (10) for removing samples and/or end crops (23) of a metal coil (1, 11, 31) comprising the following:

a support according to claim 1;

means (18), preferably a chisel, for opening the metal coil (1, 11, 31);

means (21), preferably shears, for severing a sample piece and/or end crop (23);

means for binding the metal coil (1, 11, 31) after removal of the sample and/or the end crop (23) of the metal coil (1, 11, 31).

8. A sample removal station (10) according to claim 7, which further comprises the following:

at least one contact pressure roller (16) which is arranged and constructed in such a way that it can be pressed essentially from above against the metal coil (1, 11, 31) in order to prevent a snap like opening of the metal coil (1, 11, 31);

and/or means for recoiling the metal coil (1, 11, 31).

9. A pallet system (30), particularly for storing and transporting metal coils (1, 11, 31), comprising the following:

a pallet (35) which comprises a support according to claim 1.

10. A pallet system according to claim 9, wherein means for connection for a crane transport are provided on the pallet (35) and/or on the support.

11. A reeling device (40), particularly a hot strip reel (40) which comprises a reeling mandrel (44) and a pallet system (30) according to claim 9, wherein the reeling device (40) is constructed in such a way that a metal coil (1, 11, 31), located on the reeling mandrel (44), can be stored on the support or on the pallet system (30).

12. Method of removing a sample piece and/or an end crop (23) using the sample removal station (10) according to claim 7, comprising the following steps:

placing the metal coil (1, 11, 31) on the support in the sample removal station (10) or moving the metal coil (1, 11, 31) previously placed on the support, together with the support, into the sample removal station (10);

placing the at least one contact pressure roller (16) on the upper side of the metal coil (1, 11, 31);

revering the metal coil (1, 11, 31);

uncoiling of the metal coil (1, 11, 31);

severing a sample (23);

recoiling the metal coil (1, 11, 31); and optionally binding the metal coil (1, 11, 31).

13. Method for winding a metal coil (1, 11, 31) with a reeling device (40) according to claim 11 comprising the following steps:

coiling the metal coil (1, 11, 31) onto the reeling mandrel (44);

pulling off the metal coil (1, 11, 31) including the support or the pallet system (30) from the reeling mandrel (44).

* * * * *